US011253763B2

(12) United States Patent
Whitty et al.

(10) Patent No.: US 11,253,763 B2
(45) **Date of Patent: *Feb. 22, 2022**

(54) BASEBALL HITTING APPARATUS

(71) Applicants: Raynarldo K. Whitty, Atlanta, GA (US); Bori L. Lenard, Coral Springs, FL (US)

(72) Inventors: Raynarldo K. Whitty, Atlanta, GA (US); Bori L. Lenard, Coral Springs, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/930,978

(22) Filed: May 13, 2020

(65) Prior Publication Data

US 2020/0269110 A1 Aug. 27, 2020

Related U.S. Application Data

(63) Continuation of application No. 15/583,683, filed on May 1, 2017, now Pat. No. 10,661,138.

(51) Int. Cl.

| | |
|---|---|
| ***A63B 69/00*** | (2006.01) |
| ***A63B 43/00*** | (2006.01) |
| ***A63B 43/04*** | (2006.01) |

(52) U.S. Cl.

CPC ..... *A63B 69/0002* (2013.01); *A63B 43/007* (2013.01); *A63B 43/04* (2013.01); *A63B 2069/0008* (2013.01); *A63B 2210/50* (2013.01)

(58) Field of Classification Search

CPC ..... A63B 69/0002; A63B 69/00; A63B 43/00

See application file for complete search history.

(56) References Cited

U.S. PATENT DOCUMENTS 3,907,287 A * 9/1975 Fox ..... A63B 69/0088 473/424
3,934,873 A * 1/1976 Griffin ..... A63B 43/007 473/424
4,460,172 A * 7/1984 Hogan ..... A63B 69/0091 473/426
4,706,964 A * 11/1987 Genovese ..... A63B 69/0079 473/430
4,930,776 A 6/1990 Newcomb et al.
4,993,709 A * 2/1991 Tominaga ..... A63B 24/0021 473/140
5,165,682 A * 11/1992 McGuckin ..... A63B 43/04 473/424
5,211,612 A * 5/1993 Carbonero ..... A63B 5/22 473/576
5,467,978 A * 11/1995 Paluch ..... A63B 69/0079 473/429
5,743,820 A * 4/1998 Espinosa ..... A63B 69/0079 473/429
5,810,685 A * 9/1998 Willner ..... A63B 43/00 273/335
5,842,938 A * 12/1998 Garber ..... A63B 43/007 473/430

(Continued)

*Primary Examiner* — Eugene L Kim
*Assistant Examiner* — Christopher Glenn
(74) *Attorney, Agent, or Firm* — BakerHostetler

(57) ABSTRACT

An apparatus for assisting and improving baseball hitting is described. The apparatus includes a spherical object having an interior anchor and a cord extending therefrom. An adjustable mass body is disposed within the spherical object along the cord. The interior anchor allows the spherical object to rotate about the cord.

18 Claims, 3 Drawing Sheets

(56) References Cited

U.S. PATENT DOCUMENTS

| | | | | |
|---|---|---|---|---|
| 6,142,889 | A * | 11/2000 | Schaubach | A63B 69/0079 473/415 |
| 6,334,821 | B1 * | 1/2002 | Kita | A63B 69/0097 473/430 |
| 7,252,607 | B2 * | 8/2007 | Gormley | A63B 43/007 473/423 |
| 7,547,260 | B2 * | 6/2009 | Mooney | A63B 69/0079 473/421 |
| 7,959,527 | B1 * | 6/2011 | Pitre | A63B 69/0002 473/430 |
| 7,976,414 | B2 * | 7/2011 | McKay | A63B 69/0002 473/458 |
| 8,915,826 | B2 * | 12/2014 | Publicover | B05B 17/00 482/77 |
| 9,017,229 | B2 * | 4/2015 | Gilman | A63B 21/04 482/93 |
| 9,114,284 | B2 * | 8/2015 | Orr | A63B 43/00 |
| 10,661,138 | B2 * | 5/2020 | Lenard | A63B 43/007 |
| 2004/0033848 | A1 * | 2/2004 | Bragg | A63B 69/0002 473/423 |

* cited by examiner

BASEBALL HITTING APPARATUS

CROSS REFERENCE TO RELATED APPLICATIONS

This application is a continuation of, and claims priority to, U.S. patent application Ser. No. 15/583,683, filed May 1, 2017, entitled "Baseball Hitting Apparatus," the entire contents of which are hereby incorporated herein by reference.

TECHNICAL FIELD

The present disclosure relates generally to sporting equipment and more specifically to an apparatus configured to develop hitting of a baseball.

BACKGROUND

Baseball is a popular sport in the United States and people of all ages enjoy varying degrees of participation. Players and participants enjoy various elements of baseball, including throwing, pitching, hitting, and fielding. For hitting, one should typically have the hand-eye coordination required to strike a moving ball. Participants, of course thus practice to develop these skills. Because of the nature of the sport, batting practice machines, which can eliminate the need for a human pitcher, have been developed to simulate the pitching of ball. These devices however have a disadvantage in that they require an adequate supply of balls which also must be retrieved after hitting. Other tools include tethered baseball devices where the baseball for hitting is attached to a cord allowing ready retrieval of the hit baseball. These tethered baseball devices are useful for practice, especially where space for gameplay is limited. The type of ball used in these tethered ball devices may vary. A number of balls and practice systems, including the tethered ball devices, have been developed to facilitate skill improvement. Among these conventional balls and systems however, there remains a need for an apparatus that allows users to assess and then improve their baseball hitting skills.

SUMMARY

In further examples, an apparatus may comprise a spherical object having an interior anchor disposed therein, wherein the spherical object has a plurality of orifices spaced throughout a surface of ball and wherein the spherical object has a first axial orifice. A first end of a cord may be attached to the interior anchor so as to allow the spherical object to rotate about an axis of the object. A mass body may be attached to a portion of the cord attached to the interior anchor of the spherical anchor.

In yet further examples, the present disclosure relates to a spherical object having an interior anchor disposed therein, wherein the spherical object has a plurality of orifices spaced throughout a surface of the spherical object and wherein the spherical object has a first axial orifice. A first end of a cord may be attached to the interior anchor so as to allow the spherical object to rotate about an axis of the spherical object. A mass body may be attached to a portion of the cord attached to the interior anchor of the spherical object. A stationary member, equipped with an anchoring means, may be attached at a second end of the cord to tether the spherical object.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to limitations that solve any or all disadvantages noted in any part of this disclosure.

DETAILED DESCRIPTION

Tethered baseball devices may be useful for hitting practice, particularly where there are space limitations for gameplay. A variety of baseball-like balls exists and has been utilized in place of a baseball under various circumstances, especially in tethered ball applications. A common type of ball is a round, hard plastic ball resembling a baseball and has no holes or apertures. This type of ball typically has integrally molded ridges on the outer surface to mimic the stitching on a real baseball. This round, hard plastic ball may be undesirable because its size, weight, hardness, and lack of holes there through, may cause the ball to travel in a fluttering or random pattern. Another conventional type of ball is constructed of soft plastic, usually low density polyethylene, and is hollow with a relatively thin outer wall and a plurality of apertures there through. The outer surface of the ball is generally smooth throughout. The ball can be thrown to provide different patterns can be accomplished and are accentuated despite the large amount of air resistance encountered due to the apertures of the ball. When struck, the ball can compress upon impact. A prominent example includes the WIFFLE® BALL baseball which may be used in a tethered baseball device or freely. Given the conventional practice balls however, a user may desire more diagnostic and assessment capabilities for ball-hitting practice. The baseball hitting apparatus of the present disclosure provides a tethered ball that allows the user to hit balls less hindered by friction and allows the user to better assess hitting style and performance.

Figure 1:
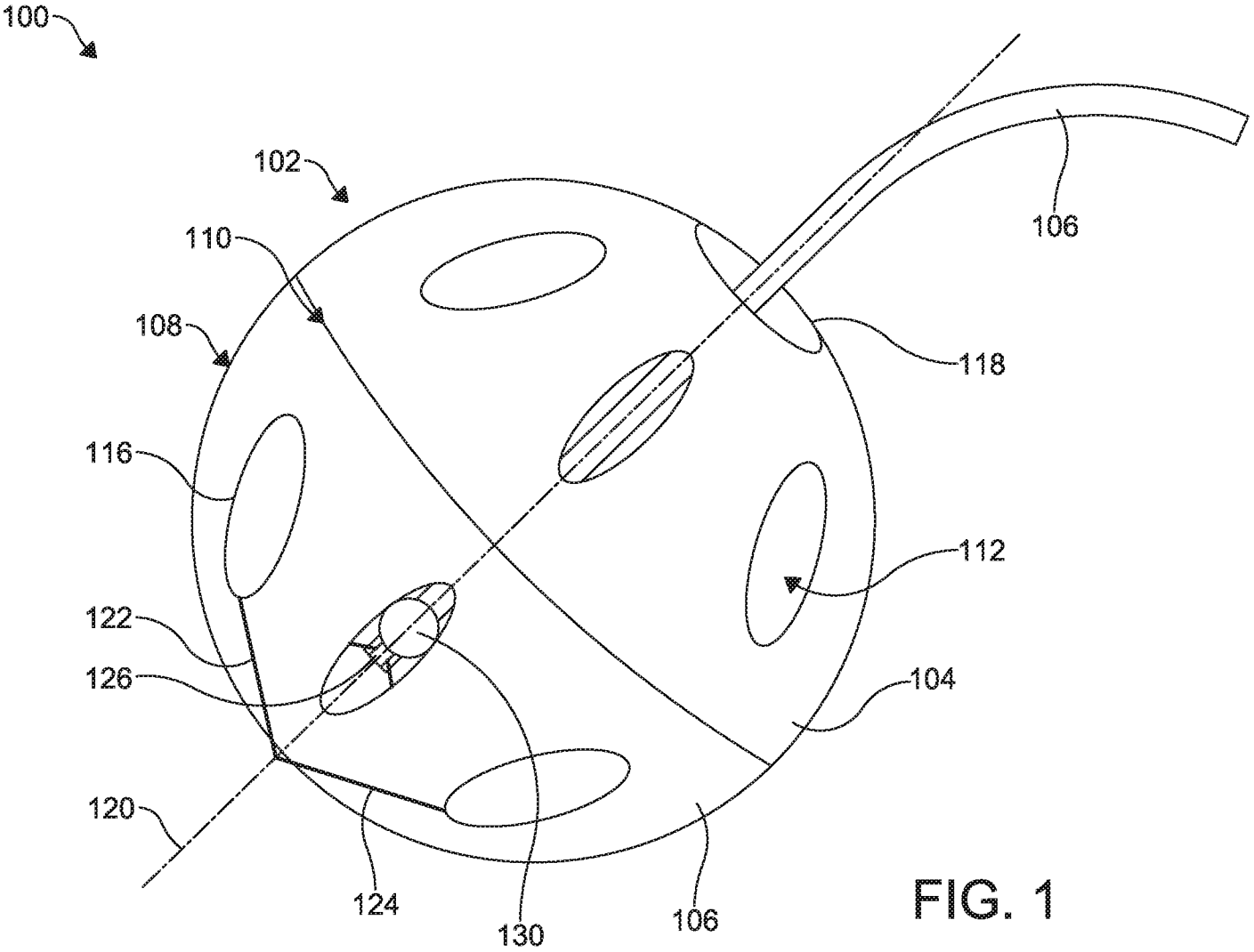
FIG. 1 illustrates a view of an exemplary baseball hitting apparatus.

Referring now to FIG. 1, not drawn to scale, an apparatus 100 of the present disclosure may comprise a spherical object 102. In certain examples, the spherical object may comprise a first hemispheric portion 104 and a second hemispheric portion 106 such that the spherical object 102 has an exterior surface 108. These portions may contact at a circumference 110 of the spherical object 102 to define an interior 112. One or both hemispheric portions 104, 106 may comprise a plurality of apertures or orifices 114, 116 spaced along the exterior surface 108 in the first and second hemispheric portions 104, 106 of the spherical object 102. The first hemispheric portion 104 may comprise a first axial orifice 118. The first axial orifice 118 may refer to the position of the orifice at an uppermost position of the first hemispheric portion 104 to provide an axis of rotation 120 for the spherical object 102.

One or more connectors 122, 124 may be attached at one or more of the plurality of orifices 116 of the second hemispheric portion 106 of the spherical object 102. The one or more connectors 122, 124 may meet at the interior 112 of the spherical object 102 at an interior anchor 126. The interior anchor 126 may be configured to join the one or more connectors 122, 124 with a cord 128 extending from the interior anchor 126 through the interior 112 and out of the first axial orifice 116 of the first hemispheric portion 104. In a specific example as in FIG. 1, these connectors 122, 124 may comprise bands 122, 124 that traverse at least a portion of the interior 112 of the spherical object 102. In traversing the interior 112 of the spherical object 102, the bands 122, 124 may overlap or intersect. Their intersection may form the interior anchor 126. The cord 128 may be attached to the interior anchor 126 of the spherical object 102 in such a manner to allow rotation about the axis of rotation 120 of the spherical object 102. A user might appreciate that rotation of the spherical object 102 about its axis of rotation 120 on the cord 128 may result in reduced friction on the spherical object 102 when in flight after being struck or thrown or otherwise put into motion. The interior anchor 126 may be disposed within the spherical object 102 by any method of attachment that secures anchor inside and does not restriction rotation of the spherical object 102 when in flight. In some examples, the interior anchor 126 may be disposed within, or affixed to, the interior of the spherical object 102 via a snap attachment, such as a button closure.

A mass body 130 may be attached to a portion of the cord 128 within the interior 112 of the spherical object 102. As shown, the mass body 130 is attached to a portion of cord 128 between the interior anchor 126 and axial orifice 118 of the spherical object 102. In various examples, the mass body 130 may be disposed at a distance at any portion of the cord 128 within the interior 112 of the spherical object 102. Thus the mass body 130 may be movable within the interior 112 of the spherical object 102. In one example, the mass body 130 may be disposed at a portion of the cord 128 corresponding to a radius of the spherical object 102 so as to allow the mass body 130 to be centered within the spherical object 102. A user might appreciate that the mass body 130 may be adjusted along the cord 128 in the interior 112 of the spherical object 102 to provide varying performance of the spherical object 102 when struck or thrown or otherwise put into motion. In other examples (not depicted in FIGs.), the interior anchor 126 may be disposed in a portion of the interior while the mass body is disposed or affixed to a distinct or separate second portion of the interior of the spherical object. Placement of the anchor and mass body within the interior of the spherical object may be configured such that any attachment disposing either the anchor or mass body does not restrict rotation of the spherical object during its flight when set in motion.

Figure 2:
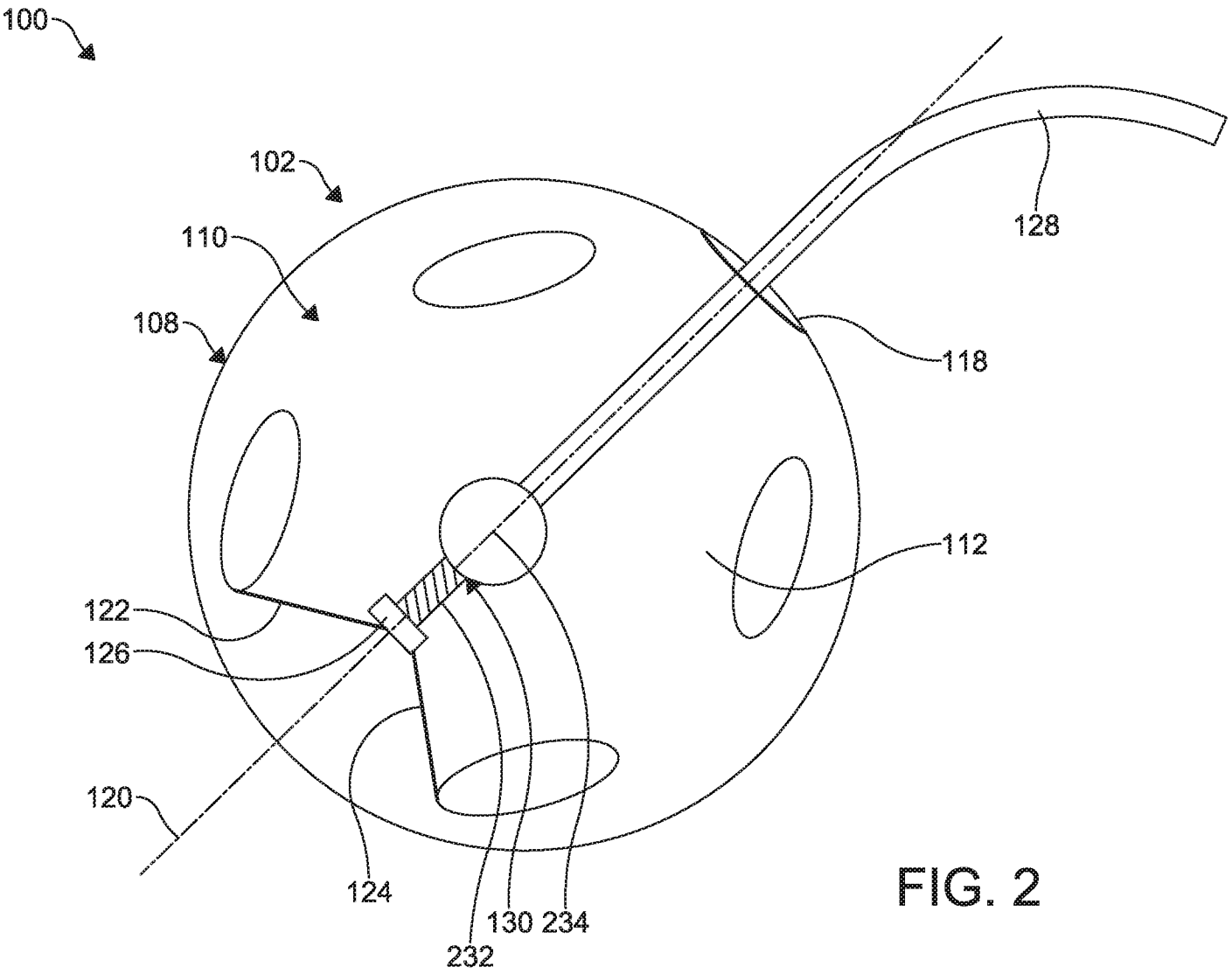
FIG. 2 illustrates a cross-sectional view of an exemplary baseball hitting apparatus.

Referring now to FIG. 2, not drawn to scale, a cross-sectional diagram provides a further view of the interior of the spherical object 102 of the baseball hitting apparatus 100. As provided herein, the spherical object 102 may have a plurality of orifices 114 spaced throughout a surface 108 of the spherical object 102. A first axial orifice 118 may be disposed in the spherical object 102 corresponding to an axis of rotation 120 of the spherical object 102. The axis of rotation 120 may refer to rotational movement about a cord 128 extending from an interior anchor 126 within an interior 112 of the spherical object 102. In some examples, the interior anchor 126 may comprise one or more connectors 122, 124 extending from one or more orifices of the plurality of orifices 114 of the spherical object 102. The interior anchor 126 may be a point of intersection within the interior 112 of the spherical object 102 of the two or more connectors 122, 124 disposed therein. A cord 128 may be attached or secured to the interior anchor 126 so as to allow the spherical object 102 to rotate about the axis of rotation 120 described herein. A mass body 130 may be disposed at a portion of the cord 128 within the spherical object 102. In one example, as presented in FIG. 2, the mass body 130 may comprise a spring system. That is, the mass body 130 may comprise a spring 232 coupled to a mass (or weight) 234.

The spherical object 102 disclosed herein may comprise a rigid, lightweight material. Exemplary materials may include foams (including polymer foams) and plastics, or combinations thereof. These plastics may include soft plastics such as low density polyurethane. Generally, the spherical object 102 may comprise a material that allows the spherical object 102 to compress to an extent upon impact. Compression of the spherical object 102 may thereby absorb at least a portion of the initial impact of contact with the spherical object 102. In a specific example, the spherical object 102 is formed from a hollow ball, that is, the spherical object 102 may be a hollow body having the cord 128, interior anchor 126, and connectors 122, 124 disposed therein, for example. The hollow ball may comprise polyurethane. Hollow as used herein may refer to having an empty space therein. The spherical object 102 may be a hollow, or substantially hollow, spherical object adapted to include the cord 128, interior anchor 126, connectors 122, 124, and additional components disposed in an empty space thereof. As such, the spherical object 102 may comprise a relatively thin wall 108 compared to a diameter of the object. For example, the spherical object 102 may have surface wall 108 with a thickness of about 3 millimeters (mm), or no greater than about 3 mm. Such a construction may also allow the spherical object 102 to compress or contract upon impact. A lightweight material, or a less dense material, comprising the spherical object 102 may also enable a longer trajectory for the spherical object when thrown or struck.

Dimensions of the spherical object 102 may depend upon its intended use, or for example, the type of sport for which the spherical object 102 is intended to be used. In certain embodiments, the spherical object 102 may be about the size of a regulation baseball and has a wall no more than ⅛ inch (3 mm) thick. In some examples, the spherical object may be the size of a regulation baseball, softball, basketball, golf ball, soccer ball, or football, or a number of other athletic and sporting balls. Accordingly, spherical object described herein device may be used to simulate the trajectory of putting into motion or of hitting a golf ball, or of shooting a basketball, or of throwing/kicking a football, or of kicking a soccer ball.

The spherical object 102 of the present disclosure may comprise a plurality of orifices 114, 116 spaced throughout a surface 108 of the spherical object 102 and extending into its interior 112. The plurality of orifices 114, 116 may be spaced in a repeating pattern across the surface 108 of the spherical object 102. For example, the plurality of orifices 114 may be spaced radially and equidistantly about the surface 108 of the spherical object 102. In some examples, the plurality of orifices 114 may be randomly spaced across the surface of the spherical object 102. The orifices 114 may comprise any shape or geometry. For example, and not to be limiting, the orifices 114 may be square, round, elliptical, rectangular, or triangular. In various aspects of the present disclosure, the orifices 114 may have an oblong or elliptical geometry. A user might appreciate that the spacing and geometry of the orifices 114 may affect a trajectory and flight pattern of the spherical object 102 when struck or thrown. In certain examples, the spherical object 102 may have a plurality of orifices 114, 116 comprising eight orifices. Each orifice may have a length of about 19 mm.

As provided herein, the baseball hitting apparatus 100 may comprise a cord 128 attached to an interior 112 of the spherical object 102. As an example, the cord 128 may be attached to an interior anchor 126 disposed within the interior 112 of the spherical object 102. A number of devices or materials may be appropriate as the interior anchor 126 of the spherical object. As provided herein the interior anchor 126 may comprise the intersection of one or more connectors 122, 124 extending from orifices 114 within the spherical object 102. In a specific example, these connectors 122, 124 may comprise bands that traverse at least a portion of the interior 112 of the spherical object. In traversing the interior 112 of the spherical object 102, the bands may overlap or intersect. Their intersection may form an interior anchor 126 for the attachment of a first end of a cord 128 configured to tether the spherical object 102. In yet further examples, the interior anchor 126 may comprise a body disposed within the interior 112 of the spherical object 102 between two or more connectors 122, 124 disposed therein.

The interior anchor 126 disposed within the interior 112 may be configured to allow the spherical object 102 to rotate about the cord 128 providing an axis of rotation 120 for the spherical object 102. Full rotations, about the cord 128 attached within the interior 112 may allow for less friction on the spherical object 102 in flight when struck or thrown. The interior anchor 126 may comprise a swivel component or rotational component that enables substantially free rotation or spinning at the interior anchor 126 thereby allowing spherical object 102 to spin or rotate on its axis of rotation 120 as the spherical object 102 is coupled to the cord 128 and interior anchor 126. As the ball may spin on its axis, friction may be reduced when compared to a substantially similar tethered ball without the ability to rotate on its axis about the tethered cord. A user may be better able to assess flight and trajectory of the spherical object 102 given the rotation of the spherical object 102 on its axis.

The cord 128 as used herein may refer to any string or string-like material that may reasonably extend from the interior anchor 126 of the spherical object 102 and exit through an orifice, which becomes an axial orifice 118, of the spherical object 102. The cord 128 may be flexible and durable so as to ensure resilience during gameplay or use of the spherical object 102. Suitable cord 128 materials may include, but are not limited to, nylon fabrics, braided or woven fabrics or threads, yarns, and polyester fabrics among others. In some examples, the cord 128 may have an elastic tendency or property allowing the spherical object 102 to recoil.

The cord 128 may be of any appropriate thickness that allows the cord 128 to extend from the interior 112 of the spherical object 102 and out an axial orifice 118. Various weights (or thicknesses) for the cord 128 are also anticipated by the examples of the present disclosure. A user may select a cord thickness to ensure that the spherical object 102 secured to the cord 128 may travel readily when struck or thrown. Exemplary cord thicknesses may include from about 3 mm to about 10 mm for a spherical object approximating the dimensions of a regulation baseball, for example, about 9 inches (specifically, no greater than 9 V) in circumference. See § 3.01 (1.09) Official Rules of Baseball by the Office of the Commissioner of Baseball). The cord 128 may be of any suitable length to allow the spherical object 102 to travel when struck or thrown.

Along the cord 128 described herein, a mass body 130 may be disposed within the interior 112 of the spherical object 102. The mass body 130 may be configured to add mass or weight to the spherical object 102. The mass body 130 may vary based on the total weight of the spherical object 102. In a specific example, the mass body 130 weighs about 5% of a total weight of the spherical object 102. In a further example, the mass body 130 weighs about 200% of a total weight of the spherical object 102. In a yet further example, the mass body 130 may be adjustable to from about 1% to about 90% of a total weight of the spherical object 102. Thus, the weight of the mass body 130 may be adjusted for user preferences and may be varied according to the weight and size or shape of the spherical object 102. By practicing with the baseball hitting apparatus described herein, a user may adjust the weight of the mass body 130 to accommodate skill level as practice and training progress. Moreover, the mass body 130 may be configured to be movable along a portion of the cord 128 within the interior 112 of the spherical object 102. For example, the mass body 130 may be disposed at a position on the cord 128 corresponding to the center of the spherical object 102 with respect to a diameter of the spherical object 102. Given this adjustable nature, the weight of the mass body 130 may be shifted to different positions within, and thus affect flight and trajectory of, the spherical object 102 when struck. A user might appreciate that adjustment of the position of the mass body 130 within the spherical object 102 may also accommodate the skill level of the user.

The user may adjust one or both of the weight and position of the mass body 130 to practice or train using the baseball hitting apparatus described herein. For example, these adjustments may allow a user to develop and improve hitting skills by allowing the user to diagnose and assess how his or her hitting techniques affect flight and trajectory of the spherical object 102 when struck by a bat for example. The user is then able to adjust, develop, or perfect their technique given this insight.

In a specific example, the mass body 130 may comprise a spring 232 coupled to a weight or mass 234. A coupled mass 234 and spring 232 comprising the mass body 130 may allow the spherical object 102 to absorb more of the force of contact when struck. The spring 232 may be suspended between the mass 234 and the interior anchor 126 of the spherical object 102. Thus, the mass 234 and spring 232 forming the mass body 130 may cooperate to function as an interior suspension system absorbing shock and redistributing force at the spherical object 102 when struck.

Figure 3:
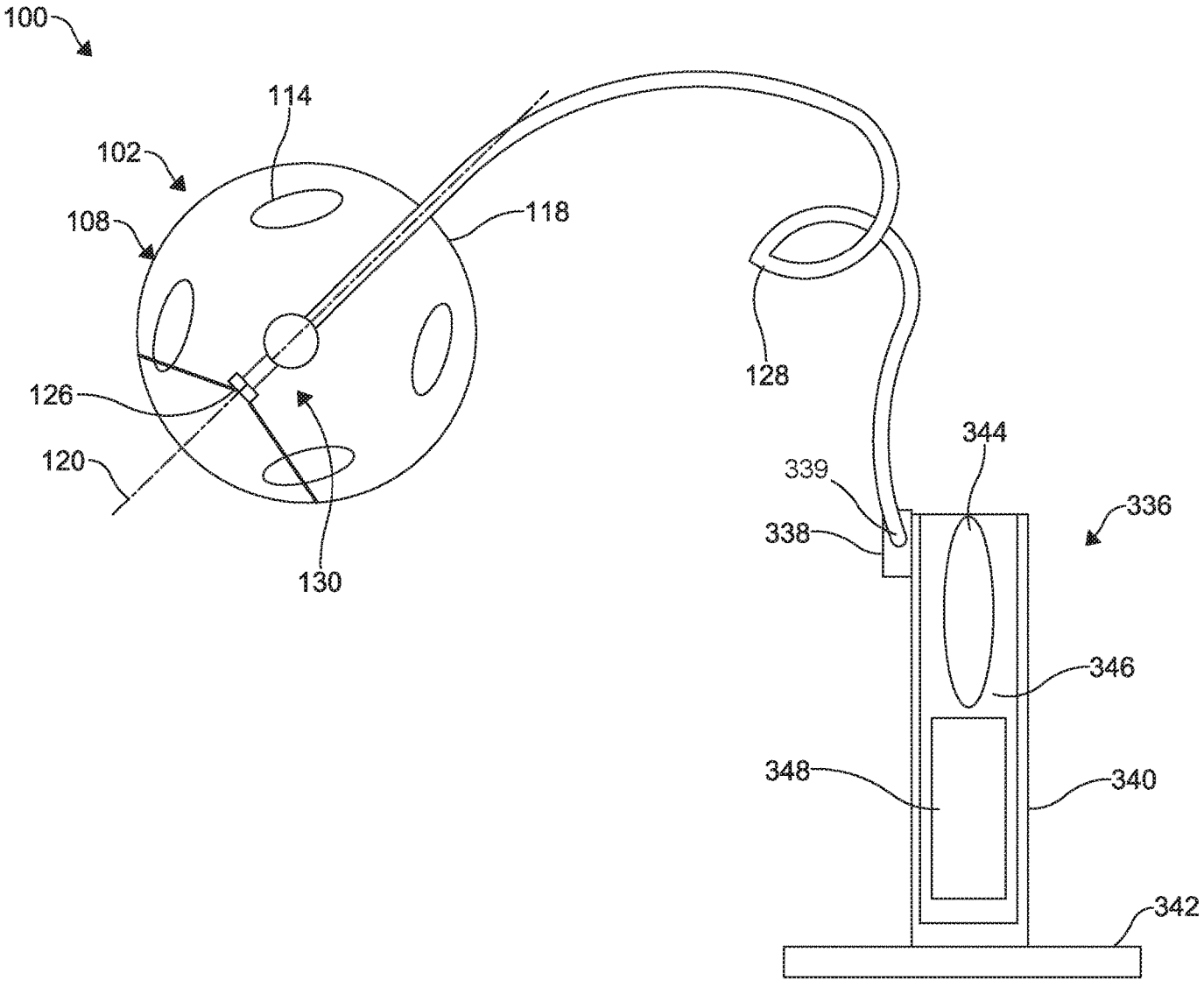
FIG. 3 illustrates a view of an exemplary baseball hitting apparatus with stationary member.

FIG. 3 illustrates a view of an exemplary baseball hitting apparatus with stationary member. The spherical object 102 described herein may be secured or tethered to a stand or a stationary member. The stationary member may be configured to elevate the spherical object 102 above a surface, such as the ground, floor, or playing field, for example. This elevation may facilitate a user in hitting the spherical object 102 with a bat or other gameplay equipment, for example. The spherical object 102 may be secured to the stationary member via the cord 128 described herein. Referring now to FIG. 3, not drawn to scale, a spherical object 102 may have a plurality of orifices 304 spaced throughout a surface 108 of the ball. A first axial orifice 118 may be disposed in the spherical object 102 corresponding to an axis of rotation 120 of the spherical object 102. A cord 128 may be attached or secured to an interior anchor 126 so as to allow the spherical object 102 to rotate about the axis of rotation 120 described herein. A mass body 130 may be disposed at a portion of the cord 128 within the spherical object 102. A stationary member 336 having an anchor apparatus 338, wherein an end, or a portion, of the cord 128 is coupled to the anchor apparatus 338 of the stationary member 336 to tether the spherical object 102. In some examples, the stationary member 336 may comprise an upright portion 340 and a flat portion 342. The stationary member 336 may be dismantled into its respective upright and flat portions 340, 342 for ease of transportation.

The anchor apparatus 338 may comprise any appropriate mechanism of securing an end 339, or a second end, of the cord 128 described herein to at least a portion of the stationary member 336. In some examples, the anchor apparatus 338 may comprise a clamp. Anchor apparatus 338 may be positioned anywhere on stationary member 336 (e.g., inside or outside, upright portion 340, flat portion 342, etc.). In an example, anchor apparatus 338 may be selectively adjustable to move along the upright portion 340 of stationary member 336. Anchor apparatus 338 may also not necessarily anchor, or secure, just an end of cord 128, but any portion of cord 128 to reduce the cord length.

As a further example, the stationary member 336 may comprise an operational region 344. The operational region 344 may be configured to allow motion of the cord 128 into and out of an interior portion 346 of the stationary member 336. In one example, the operational region 344 may comprise a reel disposed therein to retract and release the cord 128. In addition to the operational region 344, within the interior portion 346 of the stationary member 336, a retaining region 348 may be disposed. The retaining region 348 may be configured to hold or store the cord 128 within the stationary member 336 and to prevent cord 128 motion into and out of the stationary member 336.

As provided herein, the present disclosure relates to a baseball hitting apparatus. The baseball hitting apparatus may comprise a spherical object having a first hemispheric portion and a second hemispheric portion that contact at a first circumference of the spherical object to define an interior and form an exterior surface of the spherical object, wherein the spherical object has a plurality of secondary orifices. These secondary orifices may be spaced along the exterior surface of the spherical object and extend into the interior of the spherical object. The spherical object may comprise at least a first axial orifice in the first hemispheric portion. One or more connectors may be attached at one or more of the plurality of secondary orifices of the second hemispheric portion of the spherical object, the one or more connectors forming an interior anchor in the interior of the spherical object. A cord may be attached to the interior of the spherical object such that the cord extends from the interior anchor and through the first axial orifice of the spherical object allowing the cord to exit the interior of the spherical object. The cord may be attached to the interior anchor of the spherical object so as to allow the spherical object to rotate about an axis of the spherical object aligned with the first axial orifice. Finally, a mass body may be attached to at least a portion of the cord within the interior of the spherical object so that the mass body is attached to a portion of cord between the interior anchor and axial orifice of the spherical object.

The baseball hitting apparatus of the present disclosure may provide a means for practicing the sport of baseball (and its derivatives including softball). The baseball hitting may allow a user, such as player or participant, to assess hitting technique of the baseball (as the spherical object) of the apparatus. The baseball hitting apparatus 100 may allow reduced friction provided by the rotation of the spherical object 102 about the cord 128. Moreover, the mass body having a particular weight and position within the spherical object described herein may allow a user to assess varying aspects of the user's ball-hitting technique. The user may be able to assess the type of hitting or swinging necessary to produce a certain flight trajectory for a hit ball. Testing of the baseball hitting apparatus has shown that it may give a more realistic trajectory of a hit ball. When a batter swings a certain way and hits a certain position of the ball, the baseball hitting apparatus may more accurately mimic the ball flight that would be expected when a non-tethered ball is hit. The baseball hitting apparatus may allow a hitter to adjust her swing during practice sessions in a way that more accurately translates to hitting a non-tethered ball.

It is noted that while the spherical object may be characterized as "spherical" for the disclosed baseball hitting apparatus, the spherical object may have other shapes or dimensions for use in a variety of other sports as provided herein. Thus the spherical object in certain embodiments may have a different shape for use in other athletic or training endeavors. The spherical object may thus be spheroidal, globular, orb-shaped, or simply, ball-shaped. In further examples, the "spherical" object may be the size and shape of a regulation, softball, basketball, golf ball or football. Similarly, these "spherical" objects may comprise the interior anchor, mass body, and cord as described herein. Accordingly, the baseball hitting apparatus of the present disclosure may be used to simulate the trajectory of putting into motion or the hitting a golf ball, or the shooting a basketball, or the throwing/kicking of a football, or the throwing/kicking of a soccer ball.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present disclosure. All publications, patent applications, patents and other references mentioned herein are incorporated by reference in their entirety. The materials, methods, and examples disclosed herein are illustrative only and not intended to be limiting.

The singular forms "a," "an," and "the" include plural referents unless the context clearly dictates otherwise. In addition, the use of the word "or" is generally used inclusively unless otherwise provided herein.

As used in the specification and in the claims, the term "comprising" may include "consisting of" and "consisting essentially of" The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Numerical values in the specification and claims of this application, particularly as they relate to polymers or polymer compositions, reflect average values for a composition that may contain individual polymers of different characteristics. Furthermore, unless indicated to the contrary, the numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values). The endpoints of the ranges and any values disclosed herein are not limited to the precise range or value; they are sufficiently imprecise to include values approximating these ranges or values.

As used herein, approximating language may be applied to modify any quantitative representation that may vary without resulting in a change in the basic function to which it is related. Accordingly, a value modified by a term or terms, such as "about" and "substantially," may not be limited to the precise value specified, in some cases. In at least some instances, the approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

Tether as used herein may refer to the act of restricting a propelling motion of the spherical object upon being thrown or struck.

In describing preferred methods, systems, or apparatuses of the subject matter of the present disclosure—systems and methods for cross-resource subscription—as illustrated in the Figures, specific terminology is employed for the sake of clarity. The claimed subject matter, however, is not intended to be limited to the specific terminology so selected, and it is to be understood that each specific element includes all technical equivalents that operate in a similar manner to accomplish a similar purpose.

This written description uses examples for disclosure, including the best mode, and also to enable any person skilled in the art to practice the disclosed apparatus, including making and using any devices or systems and performing any incorporated methods. The patentable scope of the disclosure is defined by the claims, and may include other examples that occur to those skilled in the art (e.g., skipping steps, combining steps, or adding steps between exemplary methods disclosed herein). Such other examples are intended to be within the scope of the claims if they have structural elements that do not differ from the literal language of the claims, or if they include equivalent structural elements with insubstantial differences from the literal languages of the claims.

What is claimed:

1. An apparatus comprising:

a spherical object having an interior anchor disposed therein, wherein the spherical object has a plurality of orifices spaced throughout a surface of the spherical object;

a cord, wherein a first end of the cord is attached to the interior anchor so as to allow the spherical object to rotate about an axis of the spherical object, wherein the cord is fixably mounted to an interior wall of the spherical object via a first connector and a second connector, wherein the first connector and the second connector are attached to one or more of the plurality of orifices and the interior anchor; and a mass body, wherein the mass body is along the cord, attached to the interior anchor of the spherical object, wherein the mass body is disposed at a central position with respect to a diameter of the interior of the spherical object, wherein the mass body comprises a spring and a weighted mass, and wherein the spherical object is configured to enable a user to assess properties of the spherical object including motion, flight, and trajectory.

2. The apparatus of claim 1, further comprising a stationary member attached to a second end of the cord.

3. The apparatus of claim 1, wherein the spherical object comprises a hollow ball.

4. The apparatus of claim 1, wherein the spherical object is formed from a rigid, lightweight material.

5. The apparatus of claim 1, wherein the spherical object is formed from a plastic.

6. The apparatus of claim 1, wherein the spherical object has a spherical geometry.

7. The apparatus of claim 1, wherein the spherical object has a spheroidal, globular, oval-shaped, or oblong geometry.

8. The apparatus of claim 1, wherein the mass body is movable along the cord within the interior of the spherical object.

9. The apparatus of claim 1, wherein orifices of the plurality of orifices are randomly spaced across the surface of the spherical object.

10. The apparatus of claim 1, wherein orifices of the plurality of orifices are spaced in a repeating pattern across the surface of the spherical object.

11. The apparatus of claim 1, wherein orifices of the plurality of orifices are spaced radially and equidistantly about the surface of the spherical object.

12. The apparatus of claim 1, wherein the spherical object comprises a hollow ball of a shape and dimension of a regulation baseball, basketball, softball, soccer ball, or football.

13. A baseball hitting apparatus comprising:

a spherical object having an interior anchor disposed therein, wherein the spherical object has a plurality of orifices spaced throughout a surface of the spherical object and, a cord, wherein a first end of the cord is attached to the interior anchor so as to allow the spherical object to rotate about an axis of the spherical object, wherein the cord is fixably mounted to an interior wall of the spherical object via first connector and a second connector, wherein the first connector and the second connector comprise bands that traverse a portion of an interior of the spherical object;

a mass body attached to a portion of the cord attached to the interior anchor of the spherical object, wherein the mass body is disposed at a central position on the cord; and a stationary member having an anchoring means, wherein a second end of the cord to the anchoring means of the stationary member configured to tether the spherical obj ect, wherein the spherical object is configured to enable a user to assess properties of the spherical object including motion, flight, and trajectory.

14. The apparatus of claim 13, wherein the stationary member further comprises an operational region configured to allow free motion of the cord into and out of an interior of the stationary member and wherein the stationary member comprises a retaining region configured to prevent cord motion into and out of the stationary member.

15. The apparatus of claim 13, wherein the stationary member further comprises an operational region configured to allow free motion of the cord into and out of an interior of the stationary member, wherein the stationary member comprises a retaining region configured to store the cord.

16. The apparatus of claim 13, wherein the stationary member comprises a reel disposed therein to retract and release the cord.

17. The apparatus of claim 13, wherein the stationary member is configured to be dismantled for storage.

18. An apparatus comprising: a spherical object having an interior anchor disposed therein, wherein the spherical object has a plurality of orifices spaced throughout a surface of the spherical object; a cord, wherein a first end of the cord is attached to the interior anchor so as to allow the spherical object to rotate about an axis of the spherical object, wherein the cord is fixably mounted to an interior wall of the spherical object via a first connector and a second connector; and a mass body, wherein the mass body is along the cord attached to the interior anchor of the spherical object, wherein the mass body is disposed at a central position with respect to a diameter of the interior of the spherical object, wherein the mass body comprises a spring coupled with a weighted mass, wherein the spring functions as an interior suspension system absorbing shock and redistributing force at the spherical object when struck, and wherein the spherical object is configured to enable a user to assess properties of the spherical object including motion, flight, and trajectory.

* * * * *